US006580230B2

(12) United States Patent
Koncz et al.

(10) Patent No.: US 6,580,230 B2
(45) Date of Patent: Jun. 17, 2003

(54) ENERGY CONSERVATION DIMMER DEVICE FOR GASEOUS DISCHARGE DEVICES

(75) Inventors: Attila Koncz, Mississauga (CA); Randy Hood, Milton (CA)

(73) Assignee: 1513660 Ontario Inc. (CA)

( * ) Notice: Subject to any disclaimer, the term of this patent is extended or adjusted under 35 U.S.C. 154(b) by 0 days.

(21) Appl. No.: 09/766,716

(22) Filed: Jan. 22, 2001

(65) Prior Publication Data

US 2002/0097007 A1 Jul. 25, 2002

(51) Int. Cl.[7] ..... H05B 37/02

(52) U.S. Cl. ..... 315/291; 315/294; 315/360; 315/DIG. 4; 323/300; 323/268

(58) Field of Search ..... 315/294, 291, 315/DIG. 4, 293, 159, 297, 307, 308, 312, 316, 360; 307/31; 323/300, 299, 301, 268

(56) References Cited

U.S. PATENT DOCUMENTS 4,189,664 A * 2/1980 Hirschfeld ..... 307/130
4,574,223 A * 3/1986 Pitel ..... 307/130
5,357,170 A * 10/1994 Luchaco et al. ..... 315/284
5,402,040 A * 3/1995 Sprout ..... 315/149
5,629,607 A 5/1997 Callahan et al. ..... 315/291
5,742,131 A * 4/1998 Sprout et al. ..... 315/149
5,821,703 A 10/1998 Callahan et al. ..... 315/291
6,188,182 B1 * 2/2001 Nickols et al. ..... 315/159
6,191,568 B1 * 2/2001 Poletti ..... 315/360

* cited by examiner

*Primary Examiner*—Don Wong
*Assistant Examiner*—Ephrem Alemu
(74) *Attorney, Agent, or Firm*—Sperry, Zoda & Kane

(57) ABSTRACT

A dimmer control device is disclosed which determines when to switch a voltage level supplied to a light fixture comprised of a plurality of light bulbs by monitoring the phase relation between an input voltage and input current. When the phase relation is within acceptable tolerance limits, external control inputs to lower, i.e., dim, or raise the illumination level are accepted and processed. The dimmer control device further compensates for warmup and startup transistions by directing input voltage through relays that provide full voltage until desired voltage/current phase relation is established within acceptable tolerance levels. And further provides for a full voltage output when a failure or abnormal conditions are determined.

26 Claims, 9 Drawing Sheets

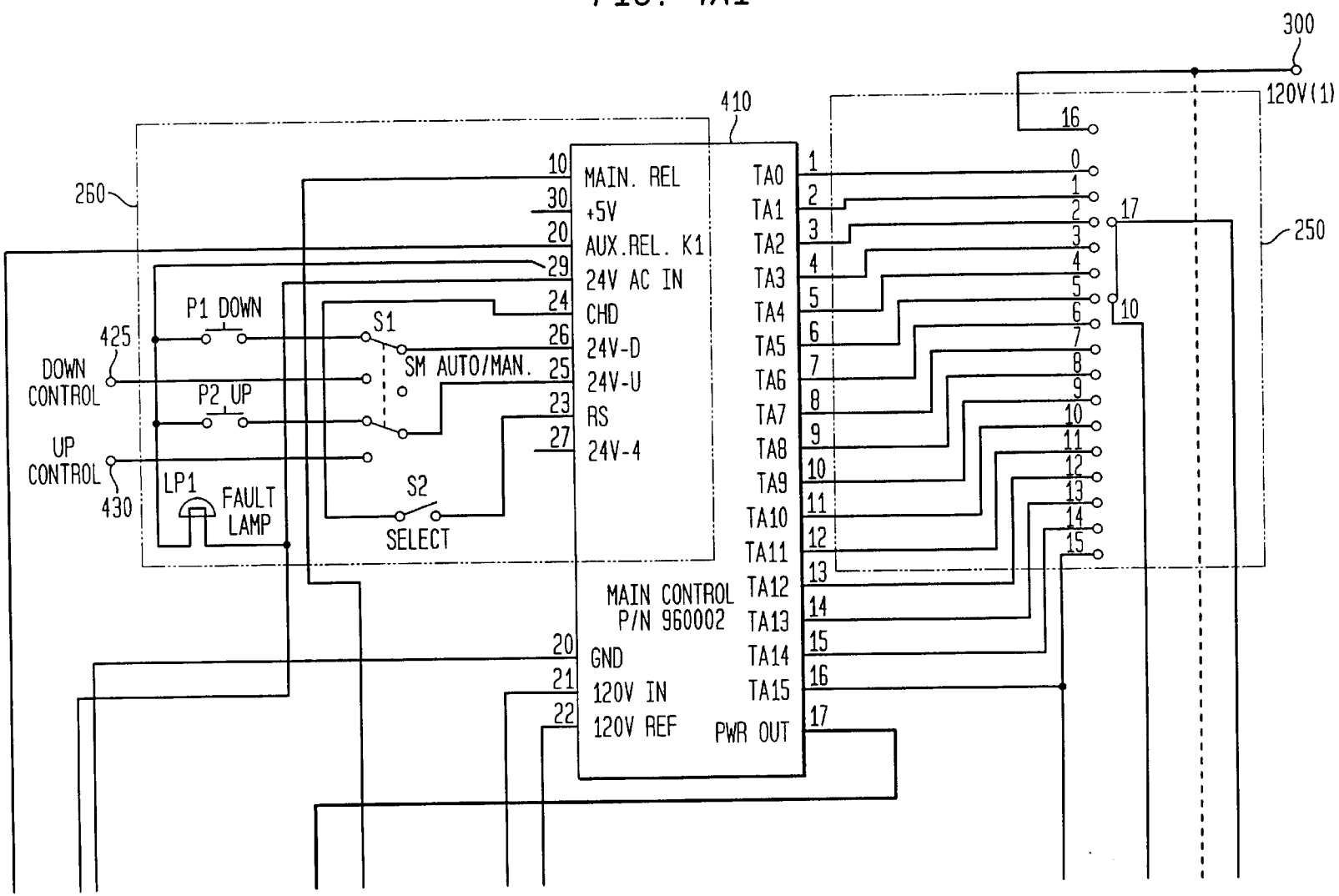
FIG. 4A1

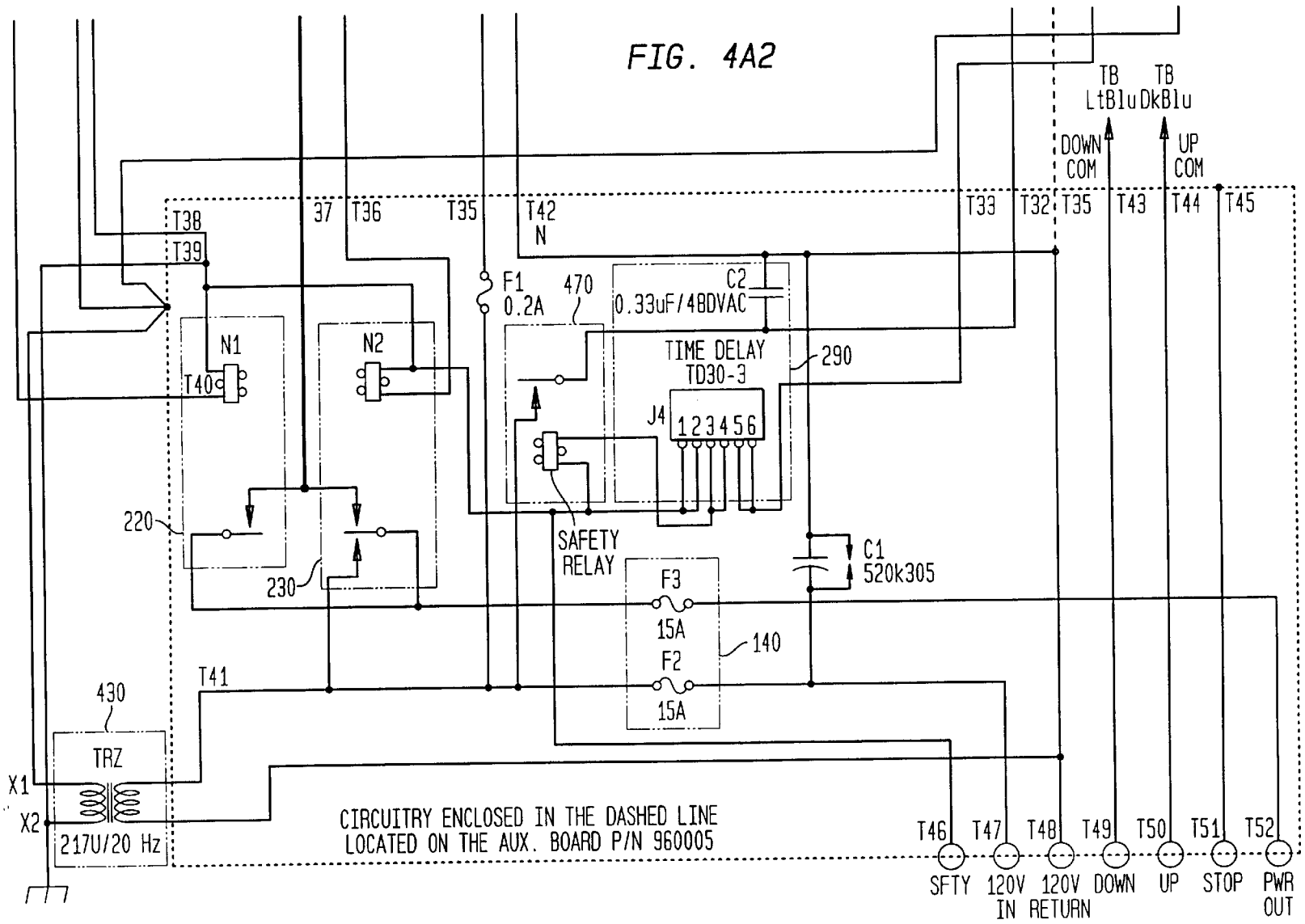
FIG. 4A2
TB LtBluDkBlu
UP COM
DOWN COM
T45
T44
T43
T35
T32
T33
T42 N
T35
T36
37
T38
T39
T40
T41
T52 PWR OUT
T51 STOP
T50 UP
T49 DOWN
T48 120V
T47 120V
T46 SFTY
IN RETURN
C1 520k305
290
C2 0.33uF/480VAC
TIME DELAY TD30-3
1 2 3 4 5 6
J4
470
F1 0.2A
SAFETY RELAY
140
F3 15A
F2 15A
N2
N1
230
220
430
TRZ
217U/20 Hz
X1
X2
CIRCUITRY ENCLOSED IN THE DASHED LINE LOCATED ON THE AUX. BOARD P/N 960005

ENERGY CONSERVATION DIMMER DEVICE FOR GASEOUS DISCHARGE DEVICES

FIELD OF INVENTION

The present invention generally relates to energy conserving light dimmers. More particularly, this invention relates to dimmers suitable for high intensity discharge (HID) gaseous lamps.

BACKGROUND OF INVENTION

The development of arc discharge lighting, particularly high intensity discharge (HID) gaseous lamps, opened a new era in lighting technology based on the improved efficacy of low pressure sodium, high pressure sodium and metal halide bulbs. HID bulbs, however, require a long time to warm up to achieve full light output. HID bulbs are thus maintained in an "on" state to avoid the long warm up time at the expense of an increase in the amount of consumed energy.

The increased use of fluorescent lamps in residential service and increasing demand for light level control resulted in the development of household type fluorescent dimming devices, which control the light level but do not efficiently conserve energy. For example, resistive dimmers are variable resistor devices that reduce the power to the light bulb in accordance to the ratio between the resistances. The overall power consumed remains essentially unchanged. Pulse Width Modulation dimmers are used predominantly with fluorescent lighting. These dimmers have a better efficacy than standard dimmers, but such dimming devices are costly for both the replacement components and the installation. Capactive or Inductive phase shifting dimmers incorporate capactive or inductive elements in the circuit to introduce a phase shift in the electrical supply to the light fixture. By selectively switching, for example, capactive, components in and out of a phase shift dimmer circuit, the phase shift and corresponding power factor, of the input voltage to the light fixture are altered. These dimmers are generally referred to as HI/LO dimmers because there is a high, i.e., full power, full illumination, position and a low, i.e., half power, half illumination, position. Variable autotransformers are another means of reducing the voltage to a light fixture by providing different input voltage levels. The different voltage levels are achieved by changing the position of a mechanical slide contacting one of a plurality of taps on the transformer. Variable auto transformers are constructed generally using toroid or linear transformers, which are more expensive than laminated core rectangular power transformers.

The current technology of dimming devices has been developed primarily for light level control and not for efficient energy conservation. Thus, while the use of gaseous discharge devices is energy efficient and the illumination can be adjusted, gaseous discharge devices consume more energy than is necessary. Hence, there is a need for dimming devices that are able to control the level of illumination of gaseous discharge devices and conserve energy in a more efficient manner.

SUMMARY OF INVENTION

The present invention discloses an apparatus to control the voltage and current levels supplied to a gaseous discharge device to dim the light output and to conserve energy. In accordance with the principles of the invention, a phase detector monitors the phase angle difference between the voltage and current applied to a gaseous discharge device, i.e., load side. When a request to alter the light output level of the discharge device is made, a controller circuit, in response to an indication of the load side voltage/current phase relationship and the requested alteration, causes a change in the supplied voltage and current. When the appropriated phase relationship is determined, the voltage level is altered in a manner such that the alterations occur in a time period, which prevents the extinguishing of the illuminating arc in a gaseous discharge device. Further, the voltage is prevented from falling below a minimum value needed to sustain the illuminating arc in the gaseous discharge device. In another aspect of the invention, the input electrical supply is provided directly to the light circuit to produce a maximum illumination output if a failure is determined to exist in the power dimmer circuit or if the voltage falls below a minimum level.

BRIEF DESCRIPTION OF THE FIGURES

The advantages and aspects of the present invention will be more fully understood in conjunction with the following detailed description and accompanying drawings, wherein:

FIGS. 4*a*1 and 4*a*2 illustrates one embodiment of the present invention;

Figure 1A:
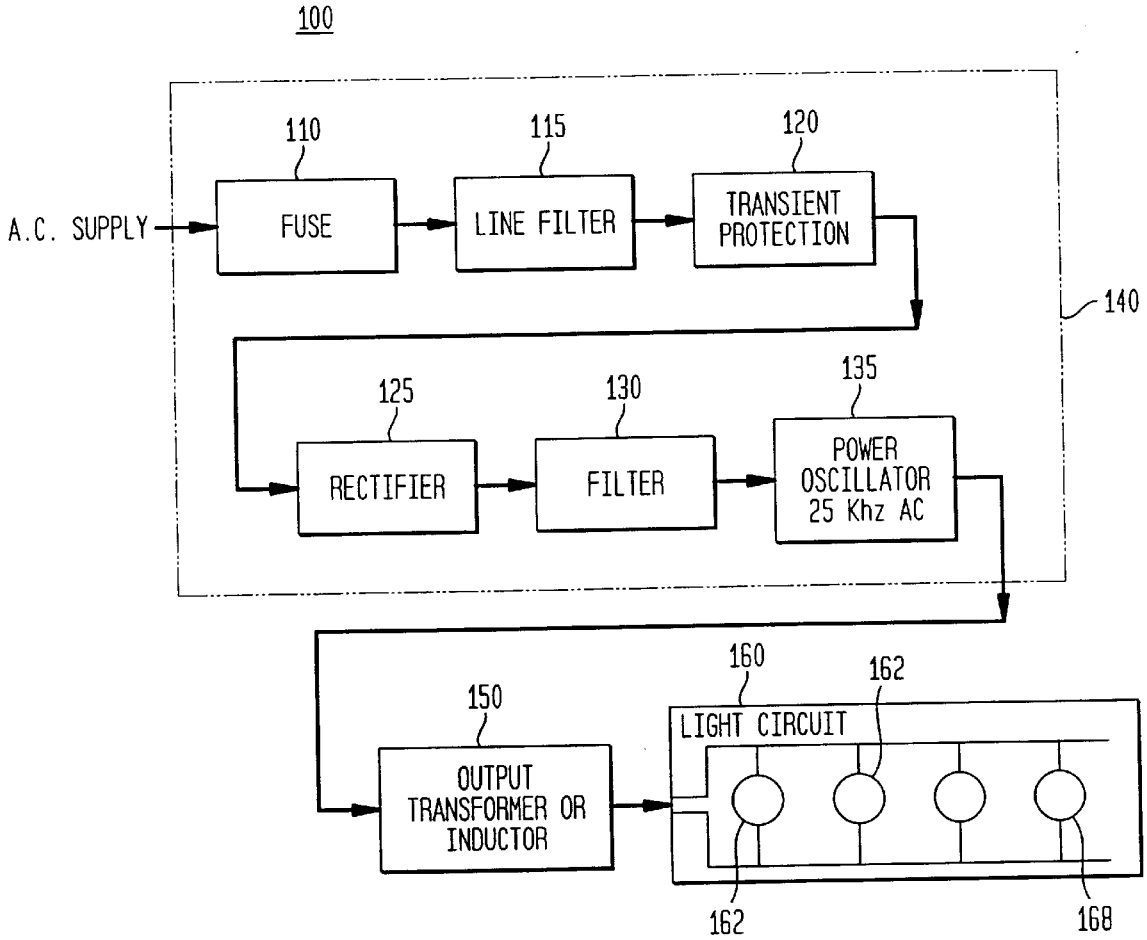
FIG. 1A (PRIOR ART)
FIG. 1*a* illustrates a conventional gaseous discharge light fixture.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a conventional pulse width modulated dimmer circuit 100 controlling the voltage level of an input electrical source to light circuit 160, which is composed of light emitting devices 60, 162, 168, etc., such as gaseous discharge devices. In this exemplary circuit, an alternating current (AC) electrical supply is provided to fuses 110, which protect the circuit components from over-voltage conditions. Line filter 115 and transient protection 120 are used to smooth irregularities in the input line voltage and aid in preventing over-voltage spikes in the AC supply from being supplied to light circuit 160. The processed AC voltage is next applied to rectifier 125, which rectifies the AC voltage. The rectified AC voltage is next applied to filter 130 to smooth any ripple in the rectified AC voltage. The rectified AC voltage is then applied to Power Oscillator 135, which generates a high frequency AC voltage. The high frequency voltage is then applied to transformer 150 to step the voltage upward or downward depending on input controls (not shown). The secondary voltage of transformer 150 is then applied to light circuit 160.

Although not shown, gaseous discharge devices, such as fluorescent and HID gaseous lamps, require ballast to operate properly. These devices produce an illumination when an arc discharge occurs through an excitable gas or vapor under controlled conditions. One of the characteristics of gaseous discharge lamps is that they operate with negative resistance. Thus, as operating current continues to flow, the negative resistance would enable the operating current to continuously increase until a lamp burns out. To regulate the flow of operating current, a positive impedance, typically resistive, device, i.e., ballast, is added to compensate for the negative resistance of the gaseous device. The ballast maintains the operating current at a substantially known level. A second important function of the ballast is to provide a voltage to the electrodes of the gaseous lamp to initiate and sustain the arc. Maintenance of an operating voltage across the gaseous arc discharge device is critical as the removal of the voltage for a time interval as short as seven milliseconds can extinguish the illumination produced by the light emanating device.

Figure 1B:
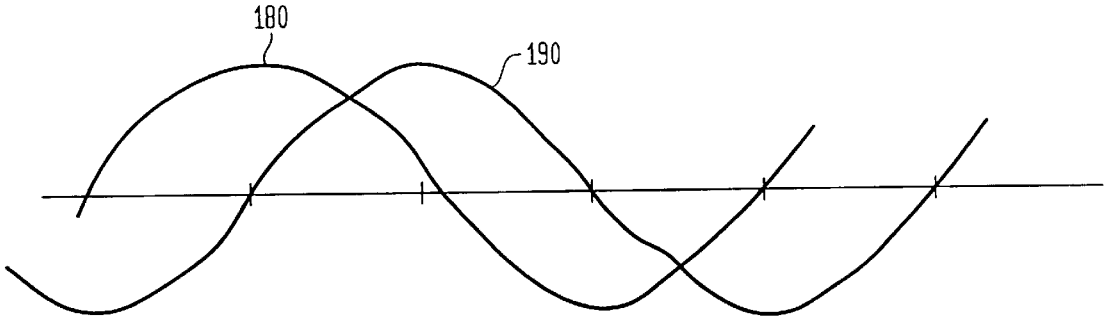
FIG. 1B (PRIOR ART)
FIG. 1*b* illustrates an exemplary electrical phase relation in a startup condition of a gaseous discharge light fixture.

FIG. 1*b* illustrates the phase relation between voltage and current of a load-side electrical source during an initial startup, or warm-up, phase of the gaseous discharge devices in light circuit 160. In this case, the gaseous devices are substantially inductive and the phase of the voltage component 190 leads the phase of the current component 180 in the order of 90 degrees.

Figure 1C:
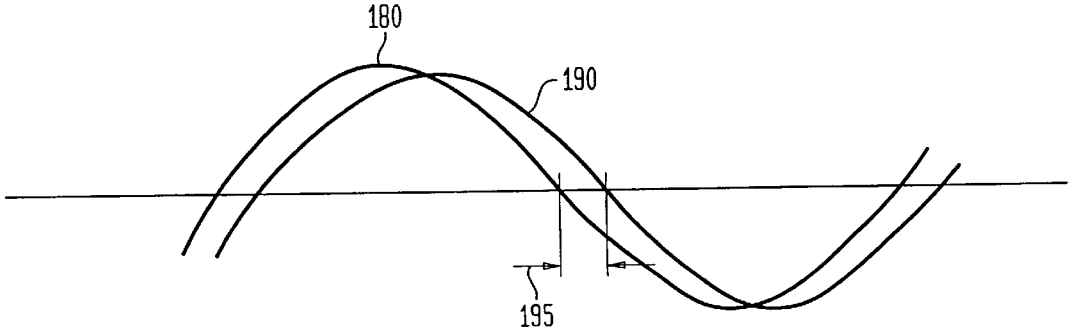
FIG. 1C (PRIOR ART)
FIG. 1*c* illustrates an exemplary electrical phase relation in steady-state condition of a gaseous discharge light fixture.

FIG. 1*c* illustrates the phase relation between voltage and current of an electrical source after the gaseous discharge devices in light circuit 160 have achieved a steady state condition. In this case, the discharge devices are substantially resistive and the phases of the voltage 190 and current 180 components remain within a narrow phase difference 195. Further, in a steady-state condition, the phase difference between the supplied voltage and current remains substantially constant.

Figure 2:
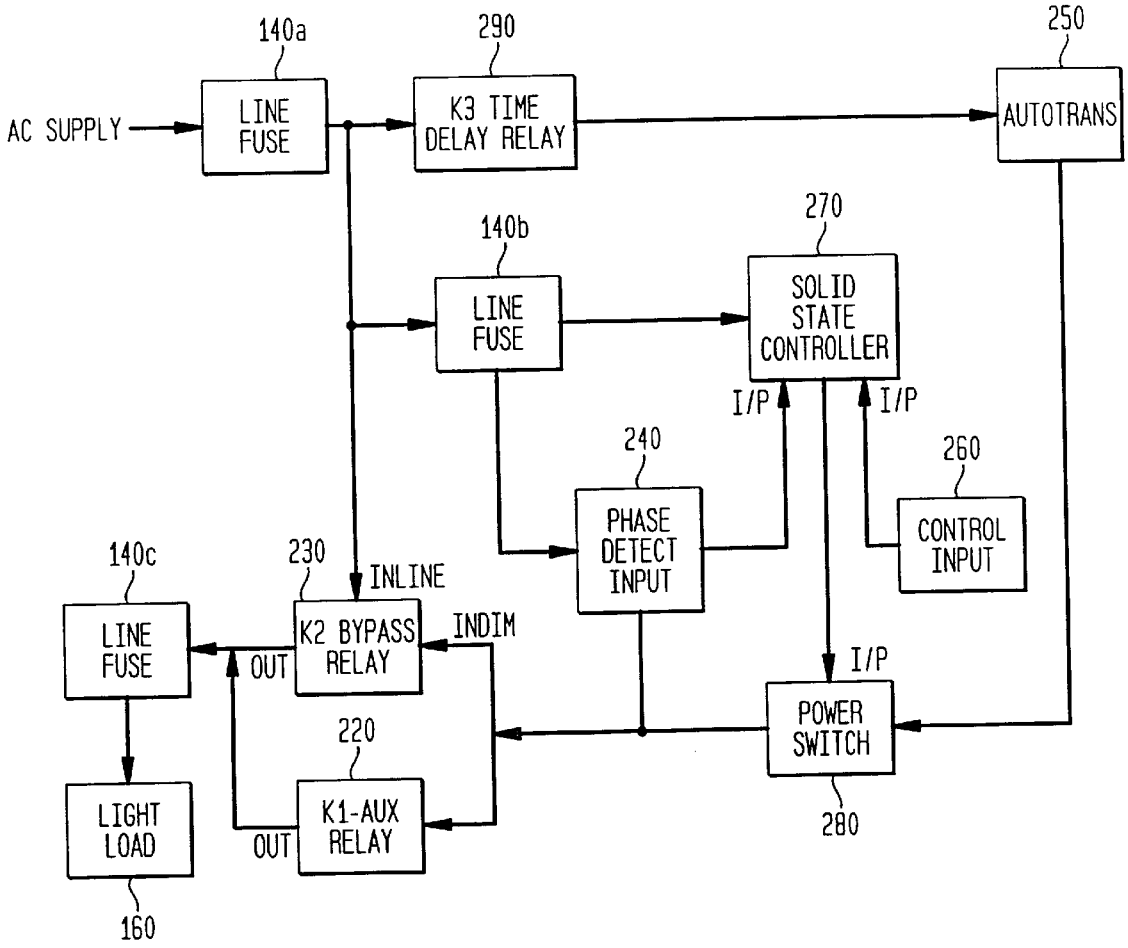
FIG. 2 illustrates a block diagram of an automatic dimmer system according to a preferred form of the present invention.

FIG. 2 illustrates, in a simplified block diagram form, a light dimmer switch in accordance with the principles of the invention. In this simplified circuit an AC power source is applied to line fuse 140*a*, which provide protection from overvoltage conditions. The voltage, or power, which are used synonymously herein, is then applied to by-pass relay, or switch, 230, line-fuse 140*b* and time-delay relay 290. By-pass relay 230 provides a direct connection of the input power supply to light circuit 160. This application of full voltage to the bulbs is important during the warm-up stage, as gaseous bulbs require a long time to generate, or strike, an arc that transverses the gaseous element within the bulb. By-pass relay 230 further provides for a fail-safe operation of the illustrated circuit. In those cases, when the dimmer circuit fails or unacceptable power conditions develop, then by-pass relay 230 is positioned to provide full input power to light circuit 160 to prevent extinguishing the HID bulbs. An optional indicator light not shown) alerts operating or maintenance personnel of this by-pass mode operation.

Line fuse 140*b* is representative of a line-in controller fuse that provides overvoltage protection for solid-state controller 270 and phase detector 240.

Time-delay relay, 290, provides a time delay to allow for a system powerup and test before voltage is applied through autotransformer 250 and power switch 280. In a preferred embodiment, a twenty-five (25) second time delay is nominally selected.

Phase detector 240 monitors the phase of the load-side AC signal during the warm-up stages and during normal operation. When it is detected that the phase angle difference between the input voltage and current exceeds a known value, then phase detector 240 provides necessary indicator signals to restrict controller 270 and power switch 280 from changing tap settings. In a preferred form of the invention, the known difference in phase angle is measured as nominally 15 degrees.

Autotransformer 250 provides a plurality of discrete variable voltage values between a pre-determined high value and a predetermined low value. The pre-determined low voltage level of autotransformer 250 corresponds to substantially a minimum operating voltage necessary to sustain the illumination of the HID lamps in light fixture 160.

Solid state controller 270 controls the dimming process, indicates operating conditions through optional visual display or audio alarms, and interfaces with control devices. Solid state controller 270 provides logical functions which control the dimming process by coordinating functions between components and interfaces with control input 260, such as external sensors, infrared sensors, keyboards, keypads, variable switches (not shown).

Power switch 280 maintains power between the AC supply and light circuit 160. Power switch 280 is composed of a plurality of semi-conductor switches, one switch for each of the plurality of taps in autotransformer 250.

In accordance with the principles of the invention, upon the application of power, by-pass relay 230 is initially operational to provide the full input voltage to light circuit 160. Phase detector 240 also initiates processes to analyze both the supply-side power condition and the load-side power condition. Controller 270 further positions auxiliary relay 220 to provide an electrical path through the dimmer circuit to light fixture 160.

When phase detector 240 determines that the phase relation between voltage and current are within acceptable tolerance levels, an indicator is provided to controller 270 which causes auxiliary relay 220 to close and provide the full input voltage to light circuit 160. Thus, both by-pass relay 230 and auxiliary relay 220 are connected in parallel, and each provides the a voltage level to light circuit 160. The system then checks the voltage output level and causes bypass relay 230 to open. Thus, the voltage to light fixture 160 is smoothly transferred through auxiliary relay 220 and the dimmer circuit controls the electrical flow to light circuit 160 through by-pass relay 230 Auxiliary Relay 220 is thereafter released.

When a light dimming request is detected, then phase detector 240 determines whether the phases of voltage and current are within acceptable tolerance limits and provides an indicator to controller 270. Controller 270, responsive to the indicator provided, then progressively selects voltages from different tap settings of autotransformer 250 until the desired voltage setting is achieved.

However, when phase detector 240 determines an irregular condition in the phases of the electrical source, control of by-pass relay 230 is removed and the full input voltage is applied to light circuit 160. Applying full voltage to light circuit 160 is representative of a default mode that provides a measure of safety. For example, an irregular power condition may be detected when at least one bulb is extinguished or bums out. In this case, the phase relation between the voltage and current is altered and rather than maintaining a dimmed light setting, the light setting is raised such that each of the remaining bulbs is producing an illumination at a designed maximum level. Optionally, an indicator or alarm can also indicate an irregularity has been detected.

Figure 3:
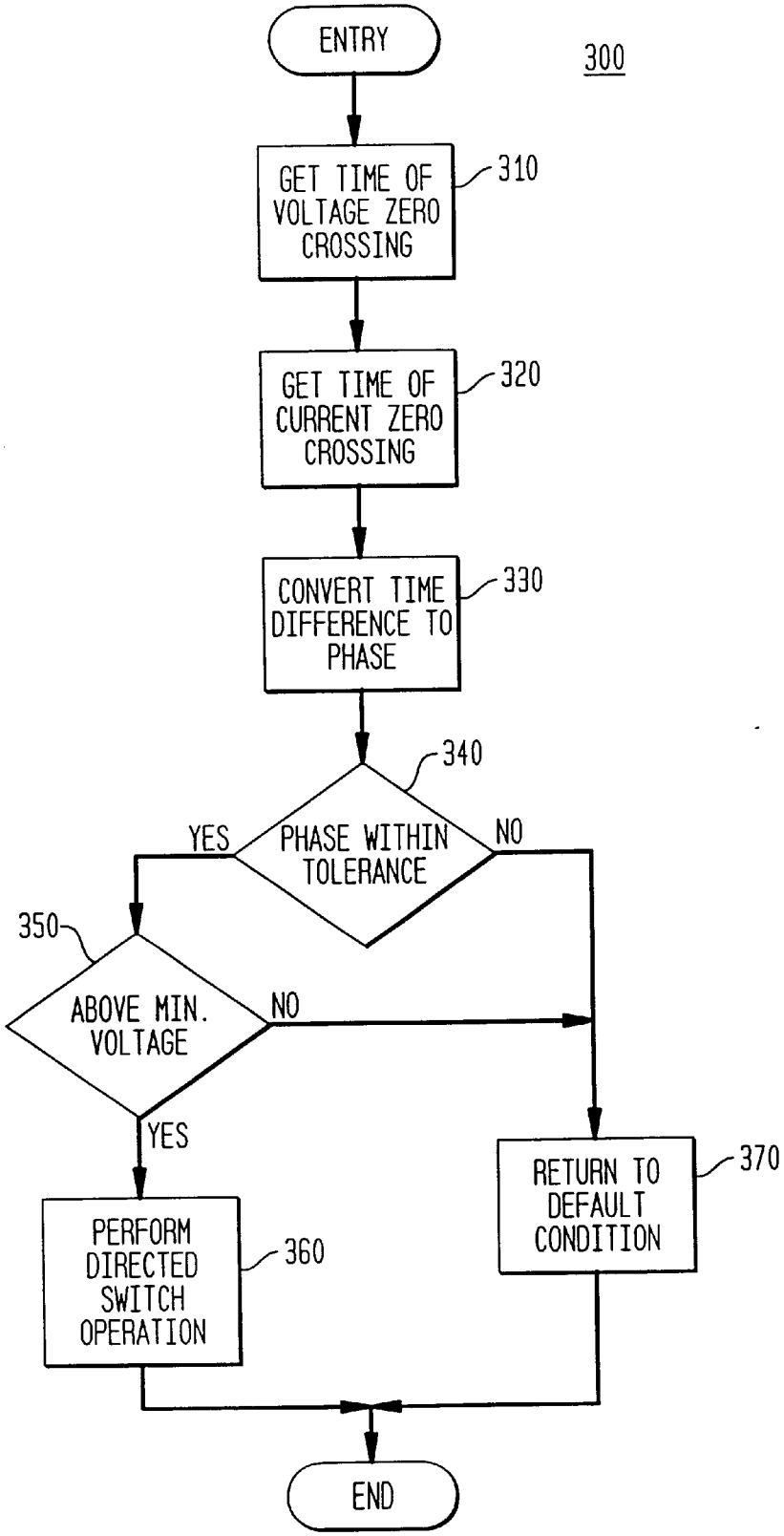
FIG. 3 depicts a flow chart illustrating exemplary processing in accordance with the principles of the invention.

FIG. 3 depicts a flow chart of processing 300 to control the dimmer circuit illustrated in FIG. 2. At block 310, the phase of the voltage component of the input electrical source is monitored to determine an indicator, e.g., a point, a time, etc., when the input voltage changes, for example, from a positive voltage to a negative voltage, i.e., a zero crossing. At block 320, the phase of the current component of the input electrical source is similarly monitored to determine an indicator, e.g., a point, a time, etc., when the input current exhibits a similar zero crossing, i.e., transition from positive-to-negative levels. At block 330, the phase of the voltage indicator and the phase of the current indicator are determined using known translation techniques. In this illustrative example, time is selected as the indicator of zero crossing. The phase difference between the determined phases of the voltage and current is also determined at block 330. At block 340, a determination is made as to whether the determined phase difference is within a known tolerance limits. If the phase difference is within the known tolerance, then a determination is made at block 350 as to whether the voltage is above a known minimum voltage. If the voltage is above a known minimum value, then the desired dimmer control operation is performed. However, if the voltage is below a known minimum value, the dimmer control operation causes the default condition to occur. That is, by-pass relay is positioned such that full input voltage is applied to light circuit 160.

Similarly, if the determination at block 340 is in the negative then the dimmer control operation causes a default condition to occur, i.e., full voltage applied to light circuit 160.

FIG. 4*a* shows a circuit diagram 400 of one embodiment of the present invention. In this embodiment of the invention, input electrical source 420, composed of a voltage and current component is applied to input/output line fuses 140, which protect circuit 400 when an overvoltage level is detected. Although input electrical source 420 is shown, and referred to herein, as 120 volt and 120 volt return, it would be appreciated that the dimmer circuit of the present invention is also applicable to electrical source levels from 110 volts to 347 volts and up to 20 amperes of current.

The voltage component of electrical source 420 is then reduced by step-down transformer 430, labeled TR2. In the illustrated embodiment, step-down transformer 430 reduces the input voltage to a conventional 24 volts. The stepped down voltage is then applied to controller input circuit 260. Controller input circuit 260 is responsive to control inputs, such as "down control" 425 and "up control" 430. Inputs down-control 425 and up-control 430, are used to cause the lowering or raising, respectively, of the voltage level provided to light circuit 160 (not shown). Although not shown, controller input circuit 260 can also receive inputs from wireless remote control devices, auxiliary sensors, control devices, etc.

Processor 410, which is representative of phase detector 240, controller 270 and power switch 280 illustrated in FIG. 2, receives input indications from controller input 260 and a plurality of alternate voltage levels from autotransformer 250. In this illustrative example, autotransformer 250 subdivides known input voltage 420, shown as 120 volts, into 16 stepped-down values. Generally, each tap of autotransformer 250 steps-down the voltage value in units from 2.5 percent to 10 percent depending on the number steps or taps. In this example, the step-down values are distributed in 2.5 percent steps uniformly between input voltage 435 and a voltage that is representative of a minimum voltage needed to maintain the arc discharge within the gaseous discharge bulbs of light fixture 160. Preferably, the lowest dimming level is set at fifty (50%) percent of the maximum voltage level. This lowest dimming level is based on recommendations of major light bulb manufactures and not necessarily a limitation of a lowest dimming level that is achievable.

Electrical source 420 is also applied to processor 410, which monitors the phase relation between current and voltage components of electrical source 420. Processor 410, for example, a Motorola MC68HC11, provides an indication when the phase relation is within acceptable tolerance limits. In a preferred embodiment, the tolerance level of 15 degrees is determined from the zero crossing of the input voltage. The indicator is then used by controller 270 to determine an appropriate time to change the output voltage 440 from one voltage level to another in response to control inputs, such as down-control 425 or up-control 430, within a time period to prevent extinguishing the arc in the gaseous bulb.

In this illustrated embodiment, auxiliary relay 220 is representative of a normally-open relay switch, which when closed provides the voltage output of processor 410 to voltage output port 450. By-pass relay 230, on the other hand, is representative of a normally-closed switch relay, which in the normally closed position provides input voltage 420 to voltage output port 450 and in an open position provides the voltage output of processor 410 to voltage output port 450. The position of auxiliary relay 220 and by-pass relay 230 are determined by processor 410. In the illustrated circuit, when processor 410 determines that the phases of input current and voltage are within an acceptable tolerance level, auxiliary relay 220 is driven to a closed position and by-pass relay is driven to an open position. Thus, auxiliary relay 220 and by-pass relay 230, are connected in parallel and both provide dimmer controlled voltage levels to light fixture 160. Accordingly, when the relationship between current and voltage is within acceptable limits, the output voltage is controlled, and varied, by dimmer circuit 400, in response to Up/Down/Stop command inputs.

However, when the current/voltage phase relation is not within acceptable tolerance levels, such as in a startup phase, normally-closed by-pass relay 230 returns to a closed position and the output voltage level is driven to the full input voltage level. Similarly, when a failure occurs in dimmer circuit 400 and the by-pass relay cannot be maintained in an open position, it returns to a closed position and the output voltage level is driven to the fall input voltage level.

Further illustrated is timer 460, which is used to provide known periods of delay time to reduce transit responses, prevent false indications and provide a smooth transition of power from one mode to a next mode. For example, when power is first applied to the light circuit 160, input source voltage 420 is applied to voltage output 450 through by-pass relay 230, as previously discussed. After a known period, preferably 25 seconds, time-delay (safety) relay 290 is activated by timer 460 to provide voltage to autotransformer 250. As the large transients may exist during the initial warm-up phase, the introduced delay prevents these transients from being applied to the autotransformer 250 or the components of phase detector 240, solid-state controller 270 or power switch 280.

Figure 4B:
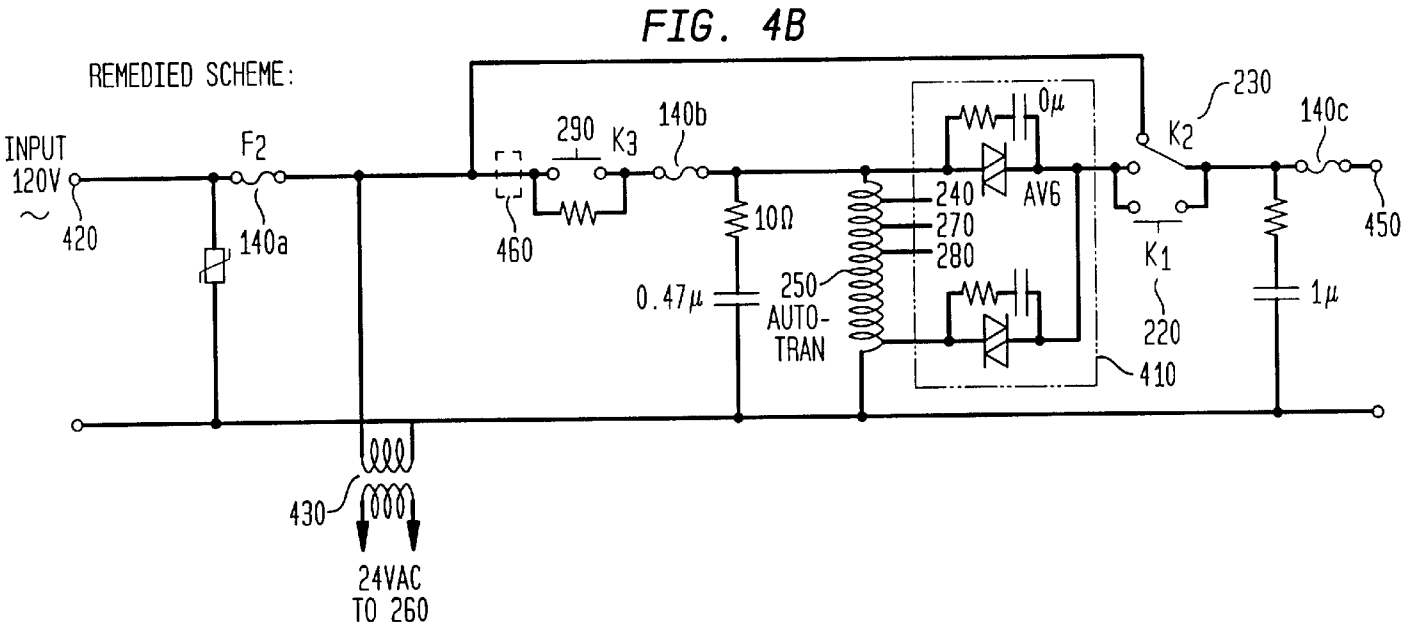
FIG. 4*b* illustrates a simplified diagram of one embodiment of the present invention.

FIG. 4*b* illustrates a simplified block diagram of the relay positions of the present invention. In this exemplary block diagram, when input power 420 is applied to the illustrated circuit, the voltage is present as an output voltage 450 through the normally FIG. 4*b* illustrates a simplified block diagram of the relay positions of the present invention. In this exemplary block diagram, when input power 420 is applied to the illustrated normally-closed by-pass relay 230. The input voltage is also applied to dimmer circuit 410 to perform a power-up self-test operation. Dimmer circuit 410, as shown, includes phase detector 240, solid-state controller 270 and power switch 280. After a known time delay, time-delay relay 290 closes and input voltage is supplied to dimmer circuit 140. Dimmer circuit 140 then determines whether correct phase relation exists in voltage and current. When a correct relation is determined, i.e., 30 minutes of time or less than 15 degrees of phase difference, then auxiliary relay 220 is closed. In this case, the input voltage is supplied to the output through both by-pass relay 220 and auxiliary relay 220. After a known period of time, in the order of seconds, bypass relay is switched to supply voltage to the output voltage 450 through dimmer switch 410. Thereafter, auxiliary relay 220 is opened and voltage is supplied to the output terminals only through dimmer switch 410.

Figure 5A:
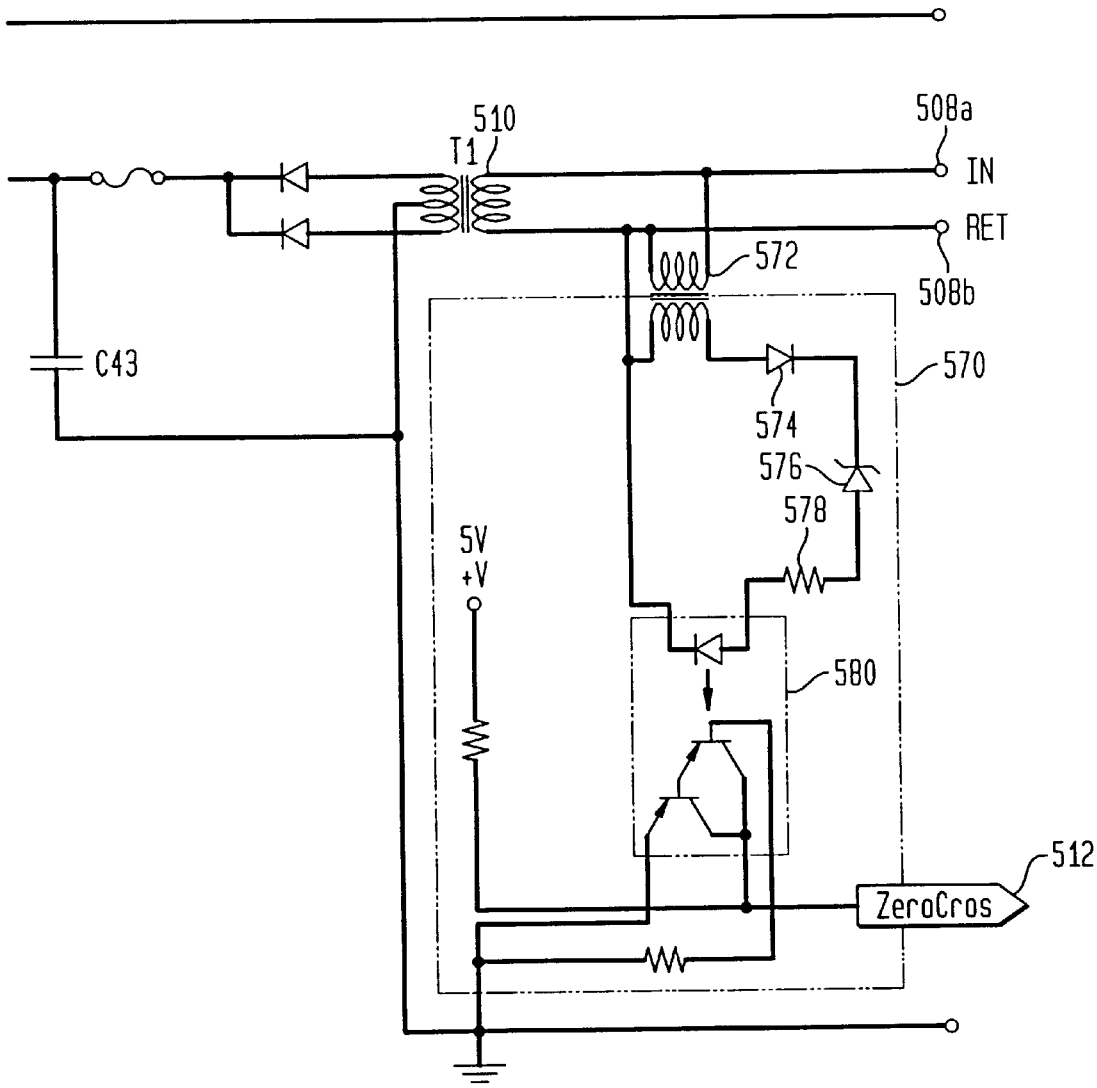
FIG. 5*a* illustrates an exemplary voltage zero-crossing phase detector.
Figure 5B:
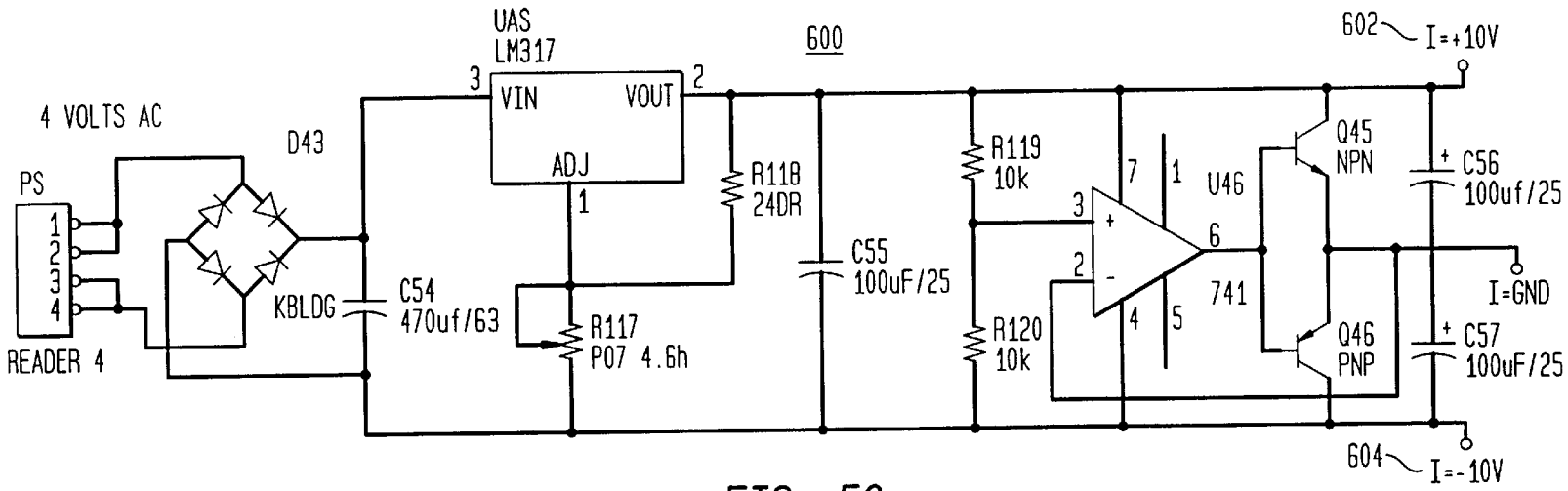
FIGS. 5*b* and 5*c* illustrate an exemplary current zero-crossing phase detector.
Figure 5C:
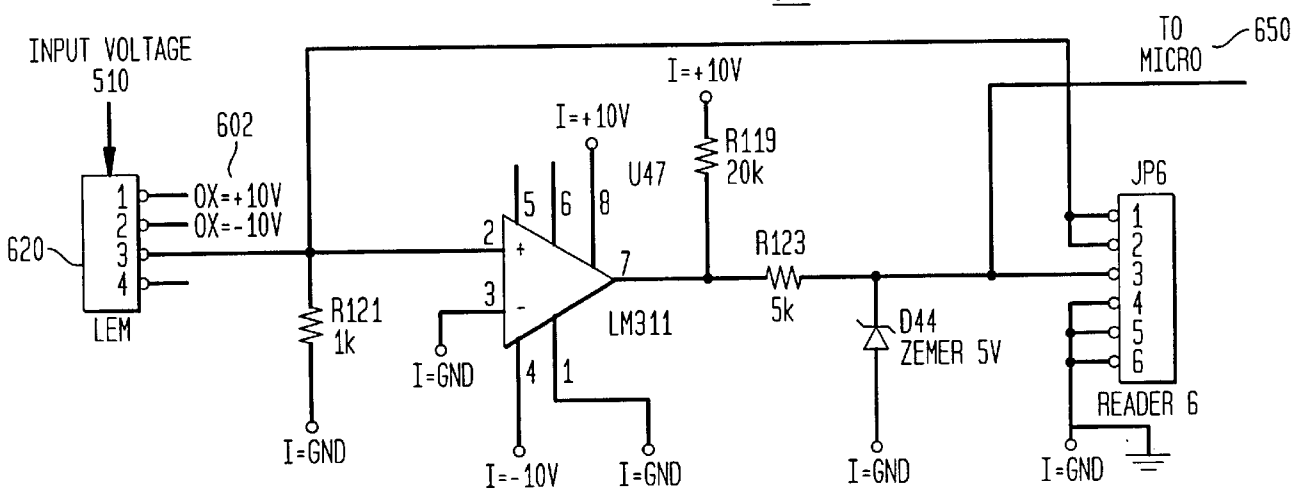

Phase detection, in accordance with the principles of the invention, is a combination of a voltage zero crossing and a current zero crossing. These determined zero crossing values are supplied to a microprocessor, which is operative to determine a phase difference as illustrated in FIG. 3. FIGS. 5*a* and 5*b* and 5*c* are illustrative of voltage and current phase detector circuits.

FIG. 5*a* illustrates an exemplary circuit 570 suitable as a voltage zero-crossing detector of phase detector 240. In this illustrated exemplary circuit, the input voltage, applied to terminals 508*a,* 508*b,* is applied to transformer 572. The output of transformer 572 is then rectified, through diode 574, such that only the positive component of the input signal is available for further processing. The cathode of diode 574 is coupled to a zener diode 576, which is used to allow signal strength above a known signal level to be processed. Zener diode 576 is then coupled through resistive device 578 to electro-optical device 580. Included within electro-optical device 580 is a light emitting diode (LED) and cascaded photo-detector. The included LED emits a particular wavelength when a signal is applied at the LED input. The cascaded photo-detector generate a signal, ZeroCros, when light is detected at its input and generates no signal when light is not detected. Signal ZeroCros is representative of the crossing of the input signal from, for example, a positive to a negative value. As would be appreciated, the signal ZeroCros may also be representative of the crossing of the input signal from a negative to a positive value.

FIGS. 5*b* and 5*c* illustrate an exemplary circuit suit for a current zero-crossing detector of phase detector 240. FIG. 5*b* is representative of well known A/DC conversion circuit 600 that to produce bidirectional direct current values 602, 604 from a known alternating current input. In this case a known +10 volt and a −10 volt output value are produced. FIG. 5*c* illustrates a current/voltage conversion circuit 610. In this example, input voltage is applied to current transducer (LEM) 620, which generates a magnetic field in relation to the input voltage value. The bi-directional voltage values produced by the AC/DC conversion circuit 602, 604 are applied to LEM 620 as reference values. The change in the magnetic field generated by LEM 620 is then interpreted as plus and minus changes in the current value. These changes 650 are then supplied to a mircoprocessor for processing.

Although not illustrated, it would be appreciated that a low operating voltage check circuit may be included in the circuit to determine whether a minimum voltage is available for continued operation. When a minimum voltage is not available, then an indicator may be supplied to the microprocessor to cause by-pass relay 230 to return to a position so that the full lighting system input voltage is applied directly to lamp circuit 160.

Figure 6:
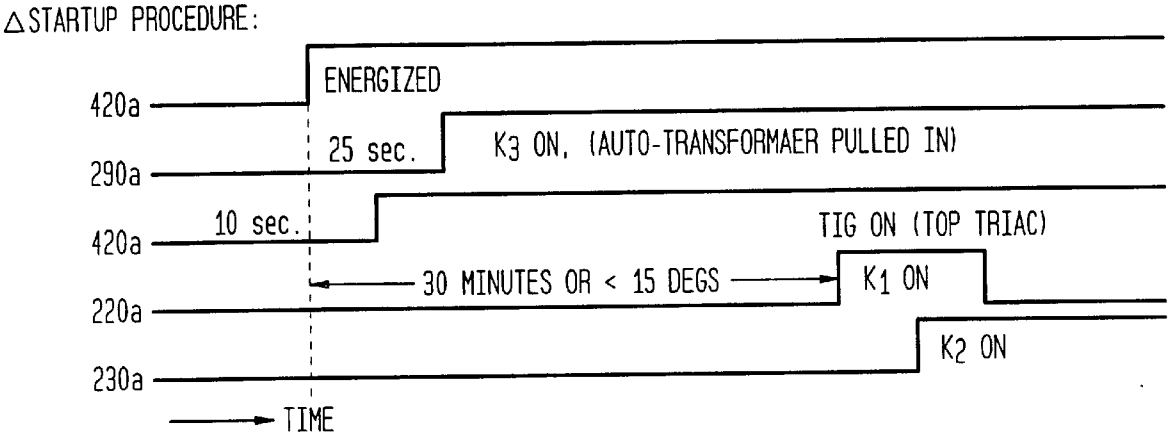
FIG. 6 illustrates an exemplary timing diagram of voltages applied to a light fixture in accordance with the principles of the invention.

FIG. 6 illustrates an exemplary time relation of the voltage levels during a startup phase of HID gaseous devices in accordance with the principles of the invention. In this illustrative example, voltage level 420*a,* corresponding to the input source voltage is applied to the dimmer circuit 400 and is made available to output port 450 through by-pass relay 230. After a known period, time 460 activates relay 470 and voltage 470*a* is applied to autotransformer 250. Voltage 435*a* is applied to a top switch of autotransformer 250. This voltage is used to provide power to the dimmer switch circuit. When auxiliary relay 220 is turned on, the voltage on the top dimmer switch path is connected in parallel to the voltage provided through by-pass relay 230. Auxiliary relay 220 and by-pass relay 230 are both providing power to output voltage port 450. The by-pass current is smoothly transferred to the dimmer switch path when by-relay is turned on, e.g. opened, and auxiliary relay 220 is turned off, e.g., closed.

By-pass relay 230 further acts as a safety relay, which is turned off, i.e., closed, when the phase relation between voltage and current are not within acceptable tolerance levels or a failure of the dimmer switch has occurred.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A dimmer control circuit to control the application of an input power source to a light fixture comprising:

a power supply member having a plurality of output taps providing a plurality of voltages varying from a predetermined minimum voltage to a predetermined maximum voltage;

a power module having a plurality of switching members with separate one switching member therein connected to a corresponding separate one output tap of said power supply member, said power module further connected to said light fixture;

a phase detector module coupled to said power supply member and being operative to determine a monitor indicator responsive to a difference in phase between a voltage of said power supply member and a current of said power supply member being less than a predefined limit;

input means to accept control inputs;

a control module, coupled to said phase detector module, operative to send a command signal in response to said monitor indicator and the control inputs, to said power module to actuate said switching members in a predetermined sequence until the light fixture reaches a level selected by the control input.

2. The dimmer control circuit as recited in claim 1 further comprising:

a first relay switch coupled between said input means and said phase detector module;

a second relay switch coupled in parallel with said first relay switch.

3. The dimmer control circuit as recited in claim 1 wherein said power supply member is an autotransformer including a plurality of output terminals supplying a plurality of voltages in a predetermined sequence from the minimum voltage to the maximum voltage.

4. The dimmer control circuit as recited in claim 1 wherein said predefined limit is defined to be less than 15 degrees.

5. The dimmer control circuit as recited in claim 1 wherein said input means is an infrared device.

6. The dimmer control circuit as recited in claim 1 wherein said input means is an external sensor.

7. The dimmer control circuit as recited in claim 1 wherein said input means is a remote control device.

8. The dimmer control circuit as recited in claim 1 further comprising:

a low voltage indicator coupled to said input source and said control module to monitor said power supply member, wherein said low voltage indicator provides an indication to said control module when the input voltage is below a known level.

9. The dimmer control circuit as recited in claim 1 wherein the lighting fixture comprises a plurality of high intensity discharge lights.

10. The dimmer control circuit as recited in claim 9 wherein said lighting fixtures are positioned electrically in parallel.

11. The dimmer control circuit as recited in claim 1 wherein the lighting fixture comprises a plurality of high pressure sodium lights.

12. The dimmer control circuit as recited in claim 11 wherein said lighting fixtures are in parallel.

13. The dimmer control circuit as recited in claim 1 wherein said lighting fixture comprises a plurality of fluorescent lights.

14. The dimmer control circuit as recited in claim 13 wherein said lighting fixtures are in parallel.

15. The dimmer control circuit as recited in claim 1 wherein said lighting fixture comprises a plurality of incandescent lights.

16. The dimmer control circuit as recited in claim 15 wherein said lighting fixtures are in parallel.

17. The dimmer control circuit as recited in claim 1 wherein said input means is a variable switch.

18. The dimmer control circuit as recited in claim 17 wherein said variable switch has a plurality of discrete steps.

19. The dimmer control circuit as recited in claim 17 wherein said variable switch is smoothly variable between a low value and a high value.

20. The dimmer control circuit as recited in claim 1 further comprising a timing circuit operative to introduce a time delay before applying said input power source to said power module.

21. The dimmer control circuit as recited in claim 20 wherein said time delay is 25 seconds.

22. The dimmer control circuit as recited in claim 20 wherein said timing circuit includes a relay.

23. The dimmer control circuit as recited in claim 1 wherein the command signal capable of being sent by said phase detector module is selected from the group of UP, Down, Stop commands.

24. The dimmer control circuit as recited in claim 23 wherein said power module progressively decreases from the predetermined maximum voltage to the predetermined minimum voltage in response to the down command signal.

25. The dimmer control circuit as recited in claim 23 wherein said power module progressively increases from the predetermined minimum voltage to the predetermined maximum voltage in response to the up command signal.

26. The dimmer control circuit as recited in claim 23 wherein said power module maintains the output voltage in response to the stop command signal.

* * * * *